US008203454B2

(12) United States Patent
Knight et al.

(10) Patent No.: US 8,203,454 B2
(45) Date of Patent: Jun. 19, 2012

(54) WHEELCHAIR ALARM SYSTEM AND METHOD

(75) Inventors: Heather-Marie Callanan Knight, Lexington, MA (US); Jae-Kyu Lee, Cambridge, MA (US); Hongshen Ma, Delta (CA); Lauren Kattany, Natick, MA (US)

(73) Assignees: The General Hospital Corporation, Boston, MA (US); Massachusetts Institute of Technology, Cambridge, MA (US)

( * ) Notice: Subject to any disclaimer, the term of this patent is extended or adjusted under 35 U.S.C. 154(b) by 493 days.

(21) Appl. No.: 12/396,402

(22) Filed: Mar. 2, 2009
(Under 37 CFR 1.47)

(65) Prior Publication Data

US 2010/0045454 A1 Feb. 25, 2010

Related U.S. Application Data

(60) Provisional application No. 61/067,888, filed on Mar. 3, 2008.

(51) Int. Cl.
*G08B 23/00* (2006.01)

(52) U.S. Cl. ..... 340/573.1; 340/573.7; 340/539.12; 340/665; 340/666; 340/667; 340/686.1; 340/686.6

(58) Field of Classification Search ..... 340/573.1, 340/573.7, 539.12, 665, 666, 667, 686.1, 340/686.6

See application file for complete search history.

(56) References Cited

U.S. PATENT DOCUMENTS

| | | | | |
|---|---|---|---|---|
| 4,934,468 | A | 6/1990 | Koerber, Sr. | |
| 5,052,065 | A * | 10/1991 | West | 5/424 |
| 5,844,488 | A * | 12/1998 | Musick | 340/573.4 |
| 5,963,137 | A | 10/1999 | Waters, Sr. | |
| 6,204,767 | B1 * | 3/2001 | Sparks | 340/573.1 |
| 6,847,301 | B1 | 1/2005 | Olson | |
| 6,870,477 | B2 | 3/2005 | Gruteser et al. | |
| 6,963,286 | B2 | 11/2005 | Marquis et al. | |
| 7,026,940 | B2 | 4/2006 | Cherubini | |
| 7,127,370 | B2 * | 10/2006 | Kelly et al. | 702/151 |
| 7,133,752 | B2 * | 11/2006 | Gray et al. | 701/1 |
| 2006/0116556 | A1 | 6/2006 | Duhamel | |
| 2008/0021731 | A1 | 1/2008 | Rodgers | |
| 2008/0242521 | A1 * | 10/2008 | Einav | 482/110 |

OTHER PUBLICATIONS

Freescale Semiconductor MC33941 Reference Manual, Nov. 2006.

* cited by examiner

*Primary Examiner* — Hung T. Nguyen
(74) *Attorney, Agent, or Firm* — Quarles & Brady LLP

(57) ABSTRACT

A wheelchair alarm system and method for preventing falls for patients at risk by recognizing the gesture of a patient attempting to stand. The wheelchair alarm system uses an array of proximity sensors and pressure sensors to create a map of the patient's sitting position, and then uses gesture recognition algorithms to determine when a patient is attempting to stand up. The wheelchair alarm system responds with light and voice alarms that can encourage the patient to remain seated and/or to make use of the system's integrated nurse-call function. The wheelchair alarm system can be seamlessly integrated into existing hospital WiFi networks, sending messages to the nurse call system as well as providing the patient's location.

18 Claims, 9 Drawing Sheets

Electric Field Lines from
Conductive Tape to Grounding Pad

WHEELCHAIR ALARM SYSTEM AND METHOD

CROSS-REFERENCE TO RELATED APPLICATION

This application claims the benefit of U.S. Provisional Patent Application No. 61/067,888 filed Mar. 3, 2008, the disclosure of which is hereby incorporated by reference.

STATEMENT CONCERNING FEDERALLY SPONSORED RESEARCH OR DEVELOPMENT

Not Applicable.

BACKGROUND OF THE INVENTION

The present invention relates generally to a wheelchair alarm system, and more particularly to a system and method for preventing falls from wheelchairs by predicting patient risk.

Patient falls are one of the biggest factors increasing hospital mortality rates. According to a recent article in Nursing Research, "Falls are the leading cause of injuries among adults aged 65 and older. Twenty to thirty percent of those who fall will require medical attention. The direct medical cost of falls is estimated at $6-8 billion per year in the United States." Furthermore, Medicare reforms mean that soon hospitals will not be reimbursed for fall-related injuries. Thus this is the ideal time to bring improved chair alarm technology to the market as hospitals will be seeking more effective fall prevention strategies in the near future.

Fall prevention technology also has the potential to impact patients in their homes. In an article titled Aging Well with Smart Technology from the publication Nursing Administration Quarterly, researchers say, "We have seen evidence of elderly remaining in their homes longer with increased levels of independence. Postponement of admission into a long-term care facility by remaining independent and healthy could show promise of decreased institutionalization with costly care and constant supervision. Using smart home applications utilizing monitors and alerts for subtle health changes could change the focus of healthcare toward wellness not illness, along with providing better coordination of care."

Elderly patients are not the only ones subject to fall. Even an athletic young person disconcerted by being on an IV is at very high risk of falling. In fact, nurses must fill out fall risk assessment forms many times a day that assess a patient's current risk of falling based on a variety of factors. In the commonly used Morse Fall Scale, these factors include; history of falling, secondary diagnosis, ambulatory aid, intravenous therapy, gait analysis and mental status.

Prior art chair alarms are generally adaptations of bed alarms. Typically, chair alarm systems are binary weight-based systems that have a delayed response to prevent their high susceptibility to false triggering. An example of a typical bed alarm system is the 1989 patent 'Hospital bed for weighing patients' (#4934468) filed by Clement J. Koerber, Sr., which uses load cells to measure patient weight and activates an alarm when the measured weight decreases below a certain threshold. However, increased movement levels lead to false triggering, thus Koerber incorporates a 4-5 second delay on the alarm's triggering that alerts staff too late.

Binary weight-based systems Furthermore, the alarms of chair alarms often go unnoticed and are not integrated into nurse call system.

BRIEF SUMMARY OF THE INVENTION

An aspect of the present invention provides a method for preventing a person from falling from a chair. The method can include the steps of sensing a plurality of seating position parameters with a plurality of sensors located on the chair, determining at least one gesture state from the plurality of seating position parameters, determining whether the at least one gesture state indicates or predicts a risk condition, and providing an alarm when the risk condition is indicated or predicted. The step of determining the at least one gesture state from the plurality of seating position parameters can include the steps of deriving a plurality of derived features from the seating position parameters, determining from at least one of the plurality of derived features a probabilistic score for the at least one gesture state, and triggering the at least one gesture state when the probabilistic score is above a threshold score. The probabilistic score can be calculated by adding the derived features associated with the at least one gesture state. The step of calculating the probabilistic score comprises weighting the at least one derived feature with a patients weight. The plurality of seating position parameters can include a plurality of distances between a chair back and a patient, a plurality of pressures on a chair seat, and a plurality of pressures on a set of chair arm rests. The plurality of derived features can include at least one static derived feature, at least one velocity derived feature, at least one time derivative derived feature, and at least one integrated derived feature. The at least one gesture state can be one of a slouching gesture state, a high movement gesture state, an attempting to exit chair gesture state, a standing up gesture state, and a falling out of chair gesture state, and a out of chair gesture state. The alarm can be a local voice alarm, a local visual alarm, and/or a remote alarm. The method can further include the step of calibrating a set of sensitivity level parameters for a specific patient, and the set of sensitivity level parameters can be used to scale the plurality of seating position parameters. The method can also further include the step of initiating an electronic voice communication channel and/or the step of initiating a nurse call. The method can further include the step of retrofitting the plurality of sensors on the wheelchair, and the plurality the plurality of sensors can include a plurality of seat back distance sensors, a plurality of seat pressure sensors, and a plurality of arm rest sensors.

Another aspect of the present invention provides an alarm system for a chair, the alarm system including a plurality of sensors configured to generate a plurality of seating position parameters, an alarm, and a controller. The controller can be configured to receive the plurality of seating position parameters, determine at least one gesture state from the plurality of seating position parameters, determine whether the at least one gesture indicates or predicts a risk condition, and activate the alarm when the risk condition is indicated or predicted. The controller can be further configured to derive a plurality of derived features from the seating position parameters, determine from at least one of the plurality of derived features a probabilistic score for the at least one gesture state, and trigger the at least one gesture state when the probabilistic score is above a threshold score. The plurality of sensors include a plurality of proximity sensors and a plurality of force sensors. The plurality of proximity sensors can be positioned on a chair back and the plurality of force sensors can be positioned on at least one of a chair seat and a chair arm. The plurality of sensors can be fitted in a wheelchair. The alarm system can further include a nurse call button configured to cause the controller to transmit a nurse call, a voice communication sub-system, and a wireless connection. The alarm can be a local audible alarm, a local visual alarm, and/or a remote alarm. The local audible alarm can be a voice alarm configured to prompt the person to remain seated.

Another aspect of the present invention provides a patient behavior tracking device and response system based on an array or sensors retrofitted onto existing furniture, intended to prevent patient falls with an emphasis on prediction not reaction. The chair alarm can use a classification algorithm to predict patient behavior based on readings from a multitude of sensors such as capacitive proximity sensors, force sensitive resistor sensors, infrared proximity sensors, load-cells, accelerometers, and the like. There can be a tiered local (sound/light) and voice response based on a calculated are integrated into a pad that could be retrofitted onto a bed, seating, or wheelchair. The alarm levels can be based on a probability of risk variable instead of an on-off binary alarm that have been traditionally used in fall-prevention applications. The voice response can be reprogrammable and can be used to provide encouraging/discouraging voice feedback when patients attempt to exit or return to the seating or bed. There can be a remote integrated visualization to centralize data and allow manipulation of wirelessly transmitted data about patient and system status. The remote integrated visualization can include a localization map that reflects alarm, call-button, and low-battery-status activation and can also enable sensor sensitivity adjustment, alarm testing and data transmission confirmation buttons. The device can also incorporate two-way communications, patient behavior history tracking, which could potentially enable behavior-based adaptive algorithms.

Embodiments of the present invention can help to prevent patient falls by recognizing that a patient is in the process of standing up, then alerting the nurse or other caregiver and encouraging that patient to remain seated or use the integrated nurse-call button if they need assistance.

Embodiments of the present invention can provide a multiple input pattern recognition system that uses a probabilistic model to predict patient behavior. The system can include a customizable voice-response system encouraging the user to sit back down or contact the nurse, an alarm localization map, a nurse call button, user calibration functionality, a patient activity log, and call reporting. The system can be integrated into the hospital wireless network.

Gesture recognition allows the embodiments of the invention to deduce the likelihood that a patient will stand, meaning a tiered response before that actual alarm triggers and even then its voice-chip-enabled ability to communicate with the patient requests their return to the chair, while the nurse is on the way. The nurse station alarm and map alerts the nurse in realtime of alarms and where they occur to help accelerate nurse response.

A chair alarm system according to an aspect of the invention can include a sensor network that measures pressure with an array of force sensitive resistors on the seat and armrests and that uses capacitive sensing to detect the patient's back position and forward lean. The system can include a usability interface on the local control box, WiFi connectivity and separate power-supplies that allow the power-consuming WiFi to be selectively disabled as well as providing specialized power for the capacitive sensing chip.

Further aspects of the present invention provide a chair alarm system that uses gesture recognition and interactive technologies to infer patient behaviors from analysis of sensor data patterns, to provide a local response and voice technologies that can encourage the patient to stay in the chair. The system can further include an integrated nurse-call button and be configured to provide a nurse's station visualization and localization map, which allows the nurse to instantly know where to look for the patient upon alarm activation.

BRIEF DESCRIPTION OF THE SEVERAL VIEWS OF THE DRAWINGS

The invention will hereafter be described to the accompanying drawings, wherein like reference numerals denote like elements.

DETAILED DESCRIPTION OF THE INVENTION

Figure 1:
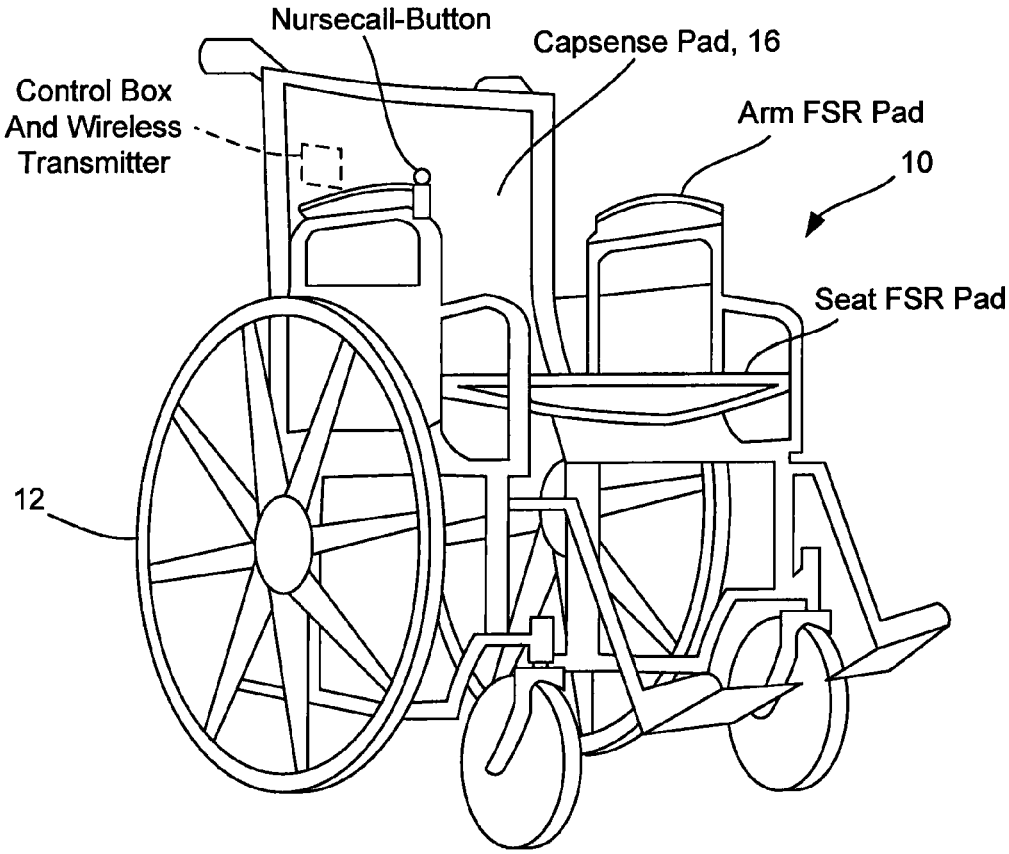
FIG. 1 is a perspective view of a wheelchair alarm system.
Figure 2:
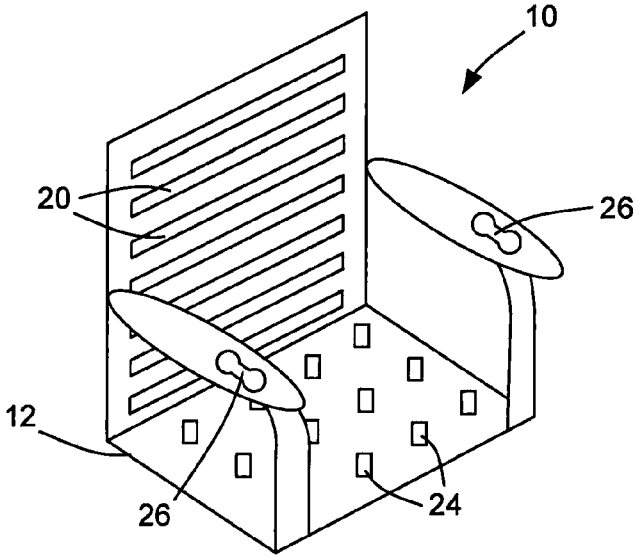
FIG. 2 is a perspective view of a set of sensors for the wheelchair alarm system of FIG. 1.

Referring now to FIGS. 1-4, a chair alarm system 10 is installed on a wheelchair 12. Chair alarm system is configured to prevent a patient from falling out of wheelchair 12, as will be discussed in greater detail below. Chair alarm system 10 includes a capacitive sensing unit 14 including a capacitive sensing chip (not shown), a capsense pad 16 installed in the back of chair 12, and a grounding pad 18 installed in the seat of chair 12. Capsense pad 16 includes seven electrodes 20 comprising horizontal strips of conducting tape that extend across the back of chair 12. Each of electrodes 20 is electrically connected to capacitive sensing chip 16, which is also connected to grounding pad 18. Hence, electrodes 20 and grounding pad 18 form seven capacitive sensors. Capacitive sensing unit 14 senses the user's movement in the region between back and seat of chair 12, in particular the distance between the user's body and each individual electrode 20, and will produce an output signal proportional to that distance. Capacitive sensing unit 14 is only activated in the presence of conducting objects. Thus, capacitive sensing unit 14 can be responsive to humans, as humans have a very high water content, but may not be triggered by books, pillows or blankets, because those are nonconducting.

Capacitive sensors' functionality depends on electric field, which is why they are only responsive to the presence of conductive objects (like humans, who are over 60% water) and do not require direct contact for activation. As capacity increases (the person is closer to the sensor) the voltage, which is normally high, is pulled down by the voltage divider network. As the signal level decreases (distance from sensor decreases) and noise levels remain similar, the signal-to-noise ratio decreases and it becomes necessary to filter out the higher frequencies with a lowpass filter.

Figure 4:
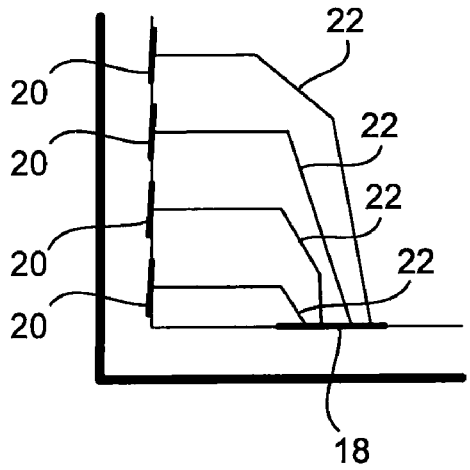
FIG. 4 illustrates a set of electric field lines from conductive tape to a grounding pad.

Capacitive sensing unit 14 monitors the posture and lean angle of a patient in the chair. If there is no patient on the chair, electric field lines 22 will pass from the seat back to the grounding pad, as shown in FIG. 4. Thus if a person or conductive object crosses those lines, it will be detected by capacitive sensing unit 14. By sitting on grounding pad 18, the patient will effectively bring the grounding pad closer to the sensing pad. Electrodes 20 on the back of the chair behave like one plate of a capacitor and will accumulate and dissipate charge at a rate set by the capacitive sensing chip. The part of the patient that is closest to electrodes 20 will represent the shortest path from the charged surface to ground, such that the capacity of the circuit rises as the person leans toward the back of the chair and decreases as they move away. Electrodes 20 can be copper tape, woven-conductive-fabric, and the like. The Shield-Electrode Pattern was chosen to maximize the Electric Field. The signals from electrodes 20 are then interfaced to the capacitive sensing chip. The capacitive sensing chip can be a commercially available chip like Freescale Semiconductor model number MC33941, which has seven channels and thus can parse data from seven different capacitive sensors at a time, as described in Freescale Semiconductor Technical Data Document Number MC33941, which is hereby incorporated by reference as if set forth in its entirety herein.

Referring now to FIGS. 1-3 and 5, chair alarm system 10 further includes sensors in the arm and seat pad of chair 12 that are pressure based and depend on the weight and movement levels of the user. A 3×4 array of rectangular force sensors 24 is disposed on the seat of chair 12. Force sensors 24 are Force Sensitive Resistors (FSRs), which, decrease their resistance as the pressure normal to their surface increases. The resistance range can be from a basically infinite resistance under no pressure to around six-hundred ohms under the highest standard pressure expected to be seen on chair alarm system 10. After processing, Force Sensitive Resistors output a voltage proportional to the amount of pressure applied in the normal direction to their surface, as described in Interlink Electronics FSR Force Sensing Resistor Integration Guide and Evaluation Parts Catalog, which is hereby incorporated by reference as if set forth herein in its entirety. Force Sensitive Resisters decrease their resistance as the pressure normal to their surface increases. The resistance range can be from a basically infinite resistance under no pressure to around six-hundred ohms under the highest standard pressure expected to be seen on chair alarm system 10.

Force sensors 24 are installed slightly forward on chair 12 for two reasons. First, because of human physiology, the very back of the seat is seldom in contact with the user and, second, the pressure levels in the forward half of the chair are more important, because they often help indicate that someone is standing up. Thus a slight shift forward concentrates sensors 24 in a more salient region of the seat. The network of seat force sensors 24 is used to track the pressure distribution and posture of a person sitting in the chair.

Each arm of chair 12 includes two force sensors 26, which are two circular Force Sensitive Resistors whose signals are added together for increased sensitivity (wired in parallel) in order to provide a total arm pressure reading. In contrast to seat force sensors 24, location information of sensors 26 is not stored as sensors 26 are installed beneath the arm cushion, which, in combination with the foam in the FSR pad, distributes the weight put on any part of the chair-arm. Sensors 26 are, however, also installed somewhat forward on the arm itself, as the physiology of hands and elbows, mean that a person is likely to support themselves by putting pressure on the front half of the chair-arm, rather than the back half.

Figure 5:
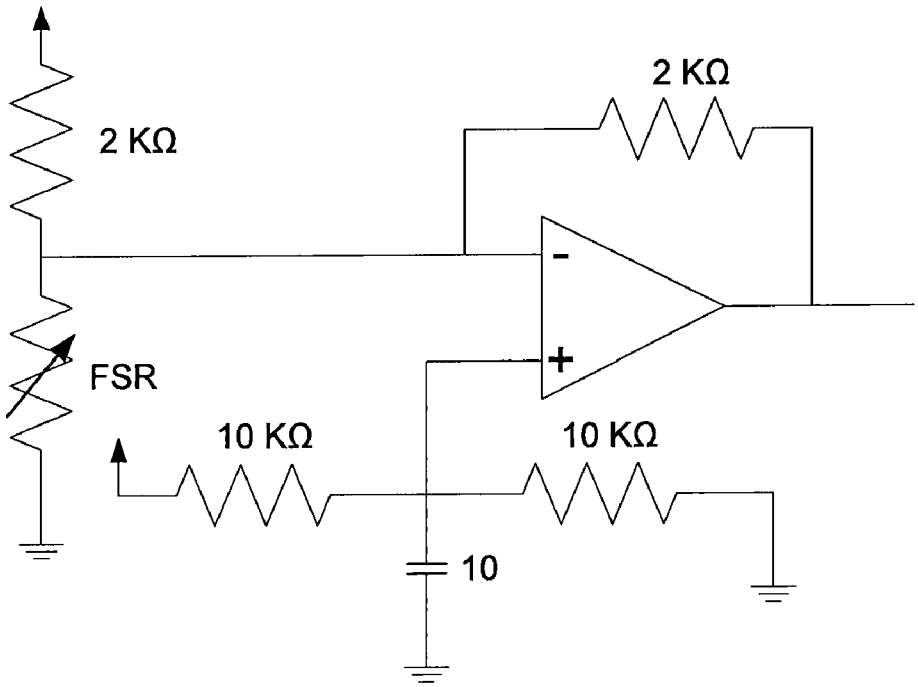
FIG. 5 is a schematic of a force sensitive resistor full-swing linearizing circuit.

During testing, several circuit topologies were evaluated, from a simple voltage divider to a linearizing op-amp setup in which the gain was R/Rfsr, where R is a fixed resistor and Rfsr is the current value of the FSR resistance. FIG. 5 depicts a linearizing circuit scheme, which outputs ground in the case of no signal and the on saturation. An advantage to this particular circuit is swing over the full voltage range and fast response.

Figure 3:
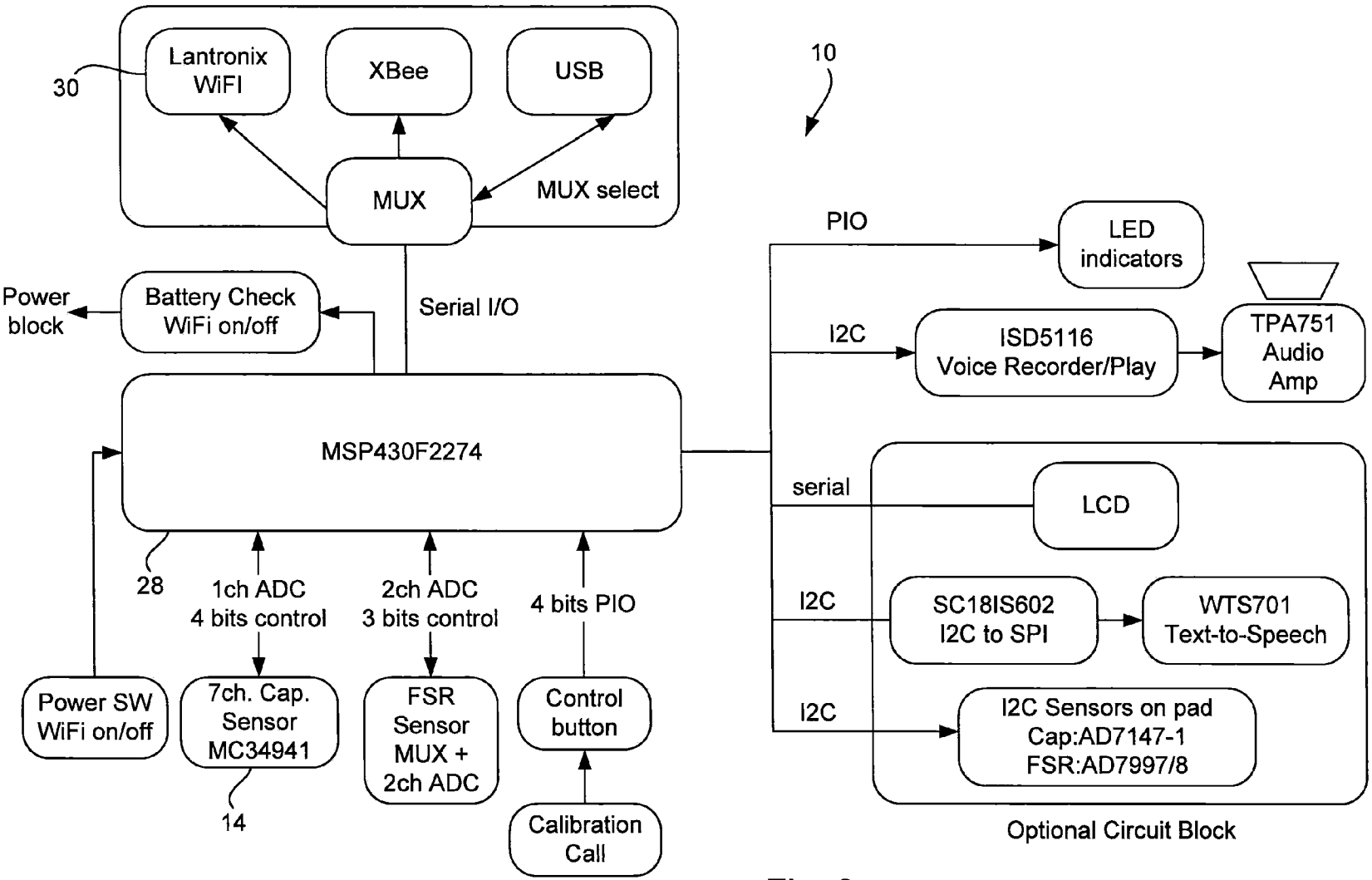
FIG. 3 is a block diagram of a wheelchair alarm system.

Referring now to FIG. 3, chair alarm system 10 includes a controller/processor 28, which can be the commercially available model MSP430 ultra low-power microcontroller from Texas Instruments, as described in the MSP430x2xx Family User guide, which is hereby incorporated by reference as if set forth in its entirety herein. Controller 28 is configured to coordinate how often the sensors are read, conduct the local pattern recognition to detect or predict a high-risk position, prompt the voice chip, activates alarms, and send serial communication data, which transmits the system status over the WiFi network.

Chair alarm system 10 can include a wireless module 30 that can wirelessly connect to local hospital networks and use routers/room assignments for localization. Wireless module 30 can be a WiPort produced by LANTRONIX. Wireless module can take in serial data from controller 28 and sends the data over wireless to a targeted computer. Wireless module 30 can include or be associated with drivers such that a computer can treat the incoming data as a virtual serial port. This can be advantageous due to the wide variety of serial interfaces that already exist to port in data to other programs. For example, that makes it very easy for the nurse's station visualization to detect and interpret the incoming data. In addition to sending sensor levels, this communication will also enable nurses to view the chair ID, the risk probability as currently calculated by the local microprocessor, whether or not a alarm is currently activated on the chair and whether the patient is making use of the nurse-call function.

Figure 6:
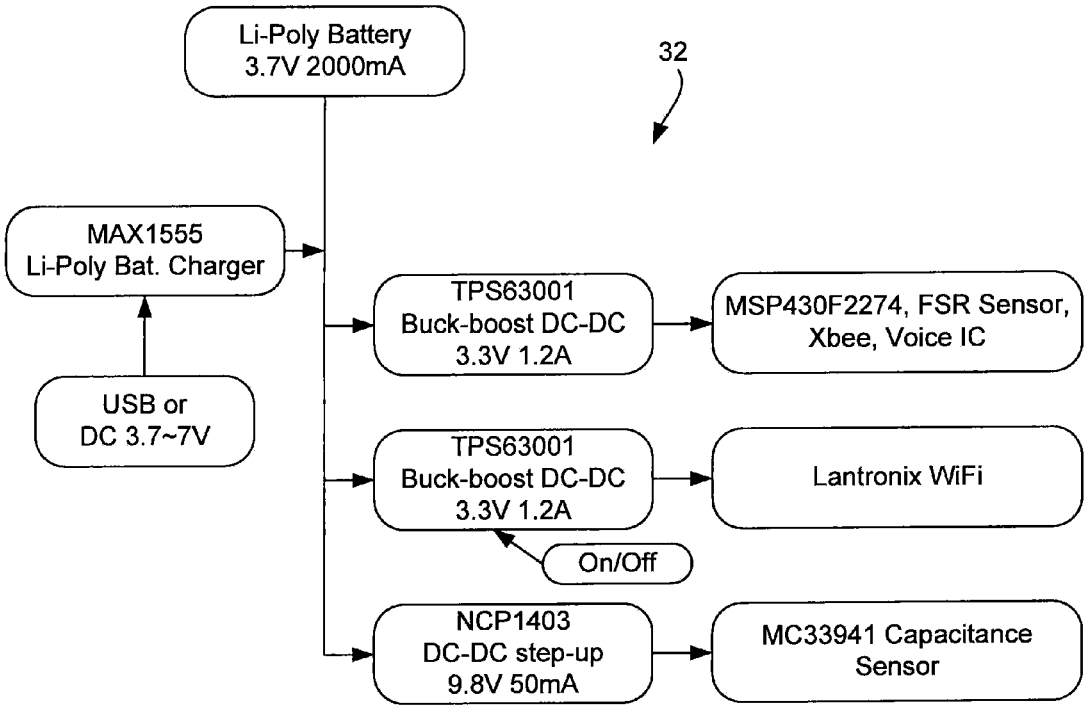
FIG. 6 is a block diagram of power supply for a wheelchair alarm system.

Referring now to FIG. 6, a power supply 32 for chair alarm system 10 comprises two 3.3V supplies and one 9.7V supply, all powered by a high power density lithium polymer battery. A separate 3.7V power supply is provided for the power-hungry WiFi communication devices, so that the WiFi can be turned off when deemed unnecessary, extending the battery life. The MC33941 Capacitive Sensor chip has a dedicated 10V power supply and the rest of the electronics use 3.7V, which can be advantageous for low power devices. A battery level indicator can also be incorporated into the local control-box and, potentially, the Nurses' Station Visualization.

Chair alarm system 10 is designed to be integrated into an existing wheelchair or chair without requiring a complex mechanical design. A layer of foam can smooth the pixelized data coming out of the seat-bottom pressure sensors. In addition to distributing the weight, the layer of form can also anchor the sensors in place, as the sensors and foam are adhered together. The foam is ⅛" thick and lines all of the seat surfaces, as well as being installed beneath the screw-attached arm-cushions.

Figure 7:
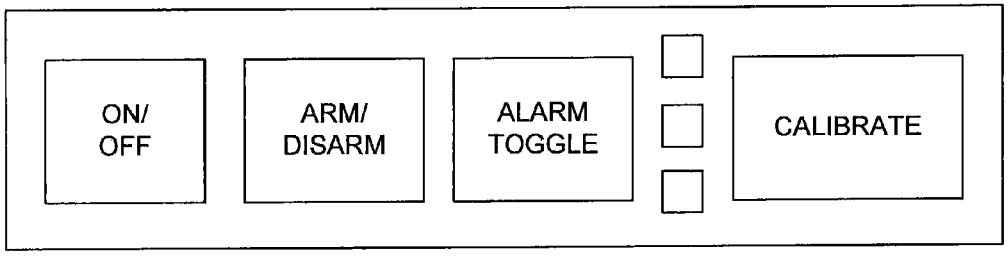
FIG. 7 is a usability interface of a wheelchair alarm system.

FIG. 7 illustrates a usability interface for chair alarm system 10. Usability interface can be a button interface on the control box on the back of the chair. The usability interface will let a nurse:

- Turn the device on or off
- Arm or disarm the alarm
- Toggle alarm mode (some combination of WiFi, sound, light and voice that will be indicated by appropriately labeled LEDs)

Recalibrate sensor sensitivity levels to the current user

A battery level indicator (not depicted in diagram)

As mentioned above, a nurse call button can be installed into the arm of the chair and integrated into the nurse call system through the chair's wireless network. This provides an alternative way for patients to contact the nurses in situations where they might otherwise try to do something unsafely themselves. This calling feature can empower the patient to be mobile without losing the capability of asking for help when it is needed.

A resettable chair ID using dip switches can be positioned on the bottom on the control box (less accessible).

For disease control consistency, a vinyl covering over the exposed seat and back pads can be used. The control box printed circuit board can be enclosed within a metal or plastic case. An appropriate adhesive can last at least one month and be semi-permanent, such that pads could easily be removed in case of failure for repairs, and could be transferred from one chair to another.

Figure 8:
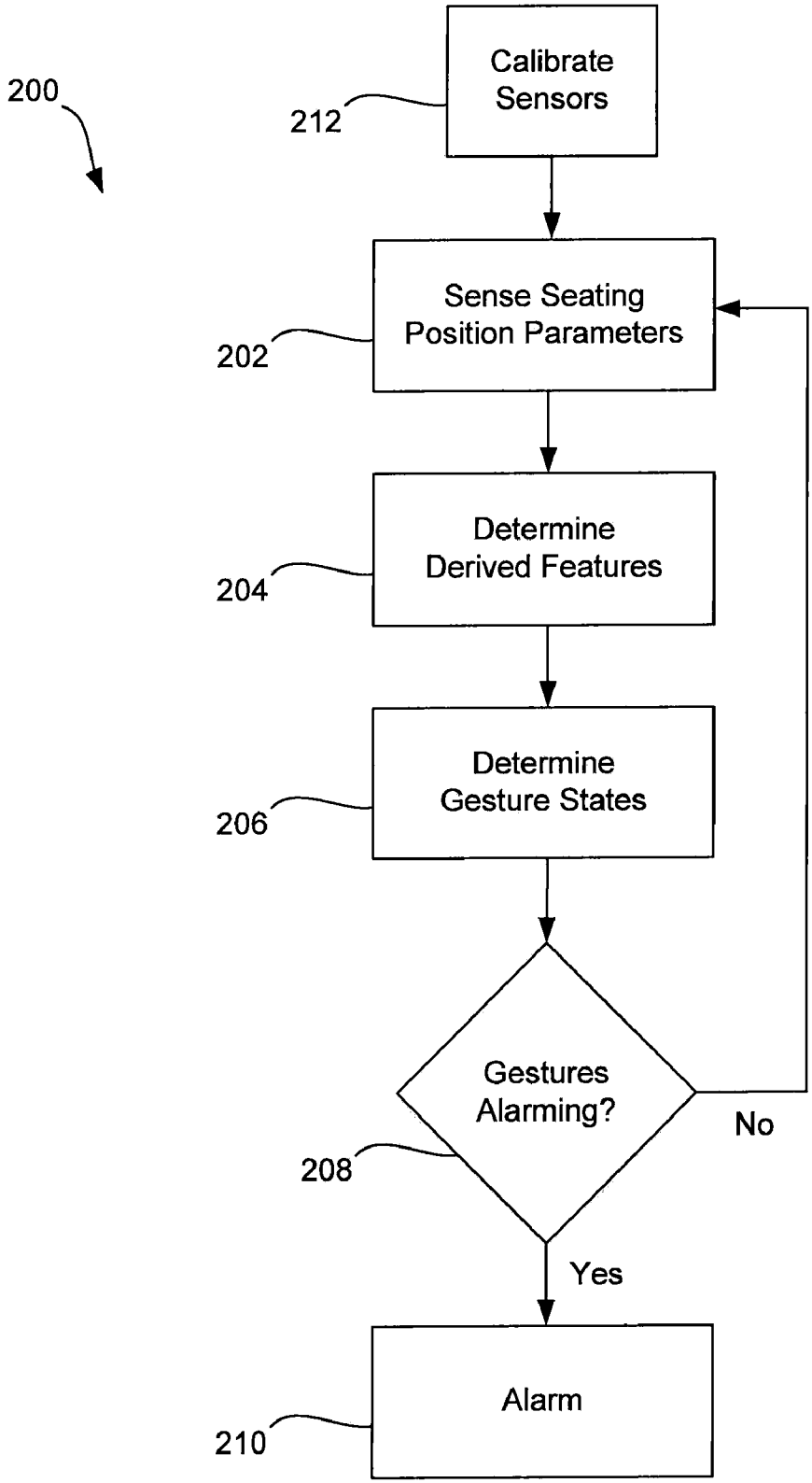
FIG. 8 is a flow chart of a method for preventing a fall from a wheelchair.
Figure 9:
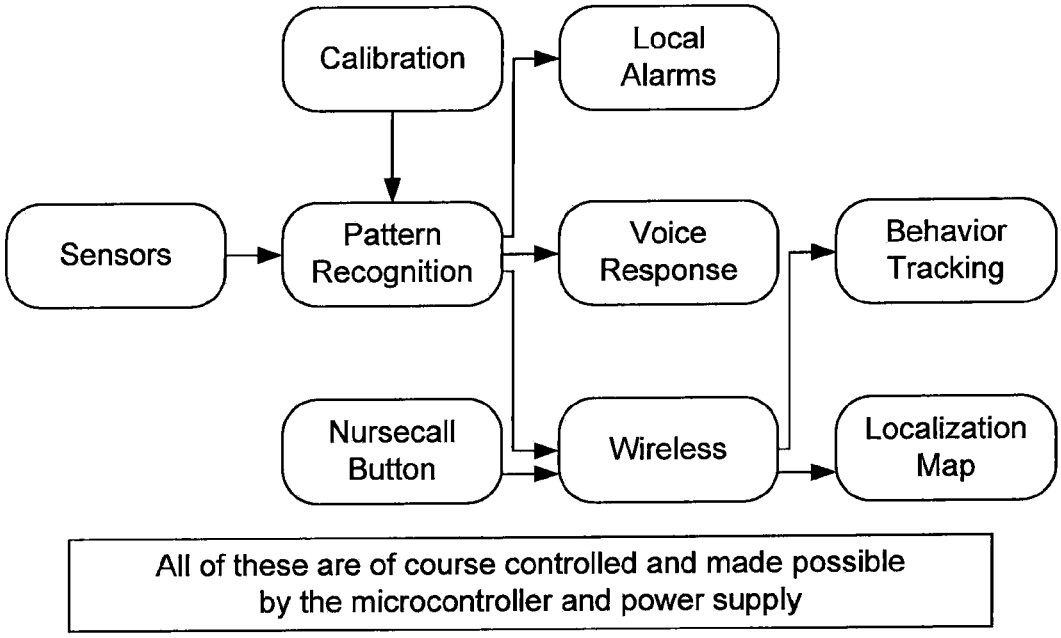
FIG. 9 is a block diagram of a set of sub-systems of a wheelchair alarm systems.

FIG. 8 shows a method 200 for preventing a person from falling from a chair. Method 200 can be practiced by chair alarm chair alarm system 10 of FIGS. 1-3, whose controller is configured to cause system 10 to perform the steps of method 200. FIG. 9 shows a block diagram of the subsystems of a wheelchair alarm system capable of practicing method 200 according to embodiment of the present invention. Method 200 can be practiced by other appropriate systems.

Turning again to FIG. 8, at step 202, a set of seating position parameters are sensed by the sensors located on the chair. The seating position parameters are raw sensor values that are scaled and normalized. Seating position parameters include the distance between the patient's back and the seat back at the seven vertical positions along the seat back, the pressure at the twelve points on the seat of the chair, and the pressured applied to each arm rest.

From the sensed seating positions parameters, a set of derived features can be determined during step 204. Pattern recognition techniques exist with many different levels of complexity. Simple classification techniques that have proven extremely successful in other contexts can be applied to characterize the behavior of the twenty-one different sensor measurements coming into the chair from the arms, seat and chair-back. The set of derived features can include the static back position, the forward leaning angle, the forward movement velocity, the integrated forward movement levels, the total bottom pressure, the bottom pressure distribution (e.g., front-back or left-right), the bottom pressure time derivative, the integrated bottom pressure time-derivative, the total integrated movement levels, the total force applied to the arm rests, the armrest pressure derivative, the integrated armrest pressure derivative, the ration of patient load taken at the arm rest versus the seat, and the like.

At step 206, the gesture states of the patient can be determined. The gesture states classify patient behavior in order to determine whether the patient is at risk of standing or falling. The gesture states are calculated or determined from the set of derived features using a probabilistic score obtained by adding values from the derived features associated with each gesture state. The weighting of each derived feature can be adjusted for the weight of the patient. A gesture state is triggered when its probabilistic score rises above a preset threshold. A decision tree can be used where each branch is determined by the weighted sums of different static and in-motion system parameters (speed of patient leaning forward, weight distribution on seat cushion, impulse pressure on arm pads) and ultimately determines the patient's risk probability. The use of a percentage-based instead of binary behavior classification means a variety of alerts can be incorporated in different contexts. For example, if the system recognized the person was leaning too far forward, it could encourage the user to sit in a more stable position and use the nurse call button if they needed assistance, though the actual local or nurse-station alarms would not yet be triggered.

The following table describes how the set of derived features can be used to obtain probabilistic scores for each gesture state, which are numbered.

TABLE 1

Figure 10:
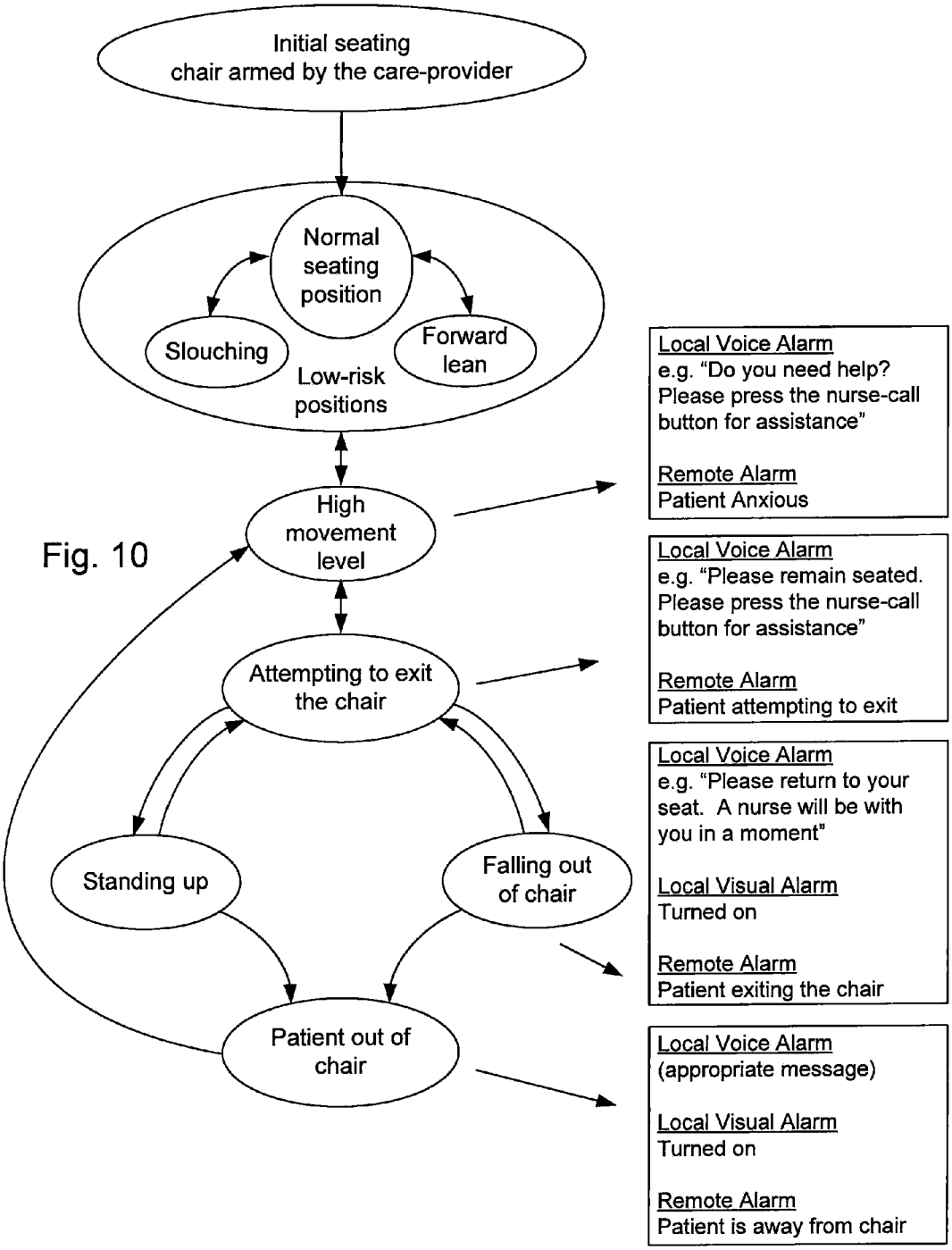
FIG. 10 is a decision tree for deciding whether to issue an alarm.

1. Initial seating
   a. Abrupt change in static back position and total bottom pressure
2. Normal sitting position
   a. Static back position
   b. Static bottom position
3. Normal forward lean
   a. Forward leaning angle
   b. Forward movement velocity below threshold
   c. Bottom pressure time-derivative below threshold
4. Slouching
   a. Bottom pressure distribution (weighted near the front)
   b. Forward leaning angle
   c. Forward movement velocity below threshold
   d. Bottom pressure time-derivative below threshold
5. High movement
   a. Forward movement velocity
   b. Integrated forward movement level
   c. Bottom pressure time-derivative
   d. Integrated bottom pressure time-derivative
6. Attempting to exit the chair
   a. Forward movement velocity
   b. Integrated forward movement level
   c. Bottom pressure time-derivative
   d. Integrated bottom pressure time-derivative
   e. Total force applied to the arm rests
   f. Armrest pressure derivative
   g. Integrated armrest pressure derivative
   h. Ratio of patient load taken at the arm rest versus the seat
7. Standing up
   a. Forward movement velocity
   b. Integrated forward movement level
   c. Bottom pressure time-derivative
   d. Integrated bottom pressure time-derivative
   e. Total force applied to the arm rests
   f. Armrest pressure derivative
   g. Integrated armrest pressure derivative
   h. Ratio of patient load taken at the arm rest versus the seat
8. Falling out of chair
   a. Forward lean angle
   b. Forward movement velocity
   c. Bottom pressure time-derivative
   d. Armrest pressure derivative
   e. Integrated armrest pressure derivative
   f. Ratio of patient load taken at the arm rest versus the seat
9. Patient out of chair
   a. Static back position
   b. Static bottom position At step 208, it can be determined whether the gesture state(s) predict or indicate a patient risk and, thus, require an alarm. FIG. 10 illustrates a decision process of step 208 and lists alarms that can be issued for different gesture states. The alarm can be a local voice alarm, a local visual alarm, and/or a remote alarm. In an embodiment, the local alarms on the chair can be light and/or sound based, depending on the dial selected.

Figure 11:
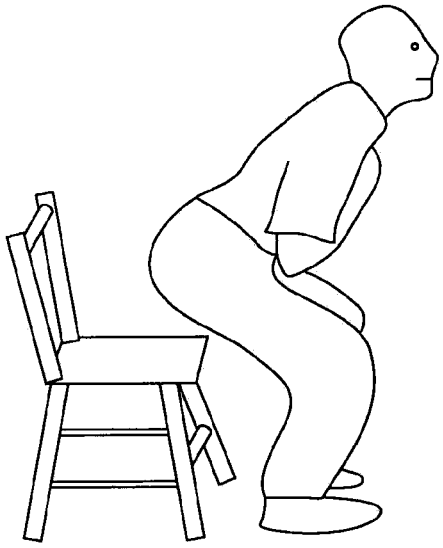
FIG. 11 is a diagram illustrating a voice alarm.

The local voice alarm is designed to provide a natural voice reminder for the patient. This alarm may be used when the patient is in a high movement state to remind them to call a nurse using the nurse-call-button. This alarm may also be used to remind the patient to sit back down when they are attempting to stand. If the patient is in trouble and in a wheel chair, the alarm can also help the care-provider to quickly locate the patient in a large room. If the user has already exited of the chair, the system can encourage them to sit back down (see FIG. 11), and provide positive reinforcement when they do. The local voice alarm could also echo mottos that the nurse's try to teach patients to promote safe hospital behavior.

The local visual alarm can be designed to help the care-provide to quickly locate the patient in a large room. It may also serve to distract a patient that is anxious to stand.

The remote alarm is designed to communicate with the care-provide when the patient is in a state of being at-risk from falling or have already exited the chair. The care-provider can be notified of the following gesture states 1) Being seated at a low-risk position, 2) High movement levels, 3) Attempting to exit the chair, 4) Standing up, and 5) Falling out of the chair. The remote alarm system can also relay patient requests for the care-provide when the nurse-call button is pressed. This alarm system is embedded into the nurse-call system in order to be interoperable with other alarm systems.

With only minor modification, the audio capabilities of the chair can be further used as an announcement or communication system between patient and nurse's station, especially with the addition of a voice-communication sub-system including a microphone. As this device extends beyond traditional hospital settings to locations such as nursing homes or residences, some of these functionalities may become principle attractions of the system.

Method 200 can include a step 212 of calibrating the sensors. Step 212 can be performed before step 202. Calibrating the sensors can be necessary because patients have a range of body-types that will require different threshold levels to interpolate between the behaviors of very differently proportioned users. The two most obvious variations involve size and weight. A small child has a much lower average pressure reading than a full-grown adult, thus the pressure reading level should be scaled before entering into the gesture characterization processing to enhance the accuracy of the behavior prediction values. A similar methodology can be used with the capacitive sensing, for the cases in which a patient is shorter or has more of a tendency to slouch. By measuring an initial controlled datastream, the baseline sensor values could be set accordingly. An average the total seat pressure readings during a preset calibration period (e.g., 20 seconds) can be used to scale the FSR sensitivity level parameter. This value can be used to scale both the arm and seat FSR values. Its scaling with total signal amplitude value should be determined after conducting a set of measurements characterizing the FSR and pattern recognition system.

Figure 12:
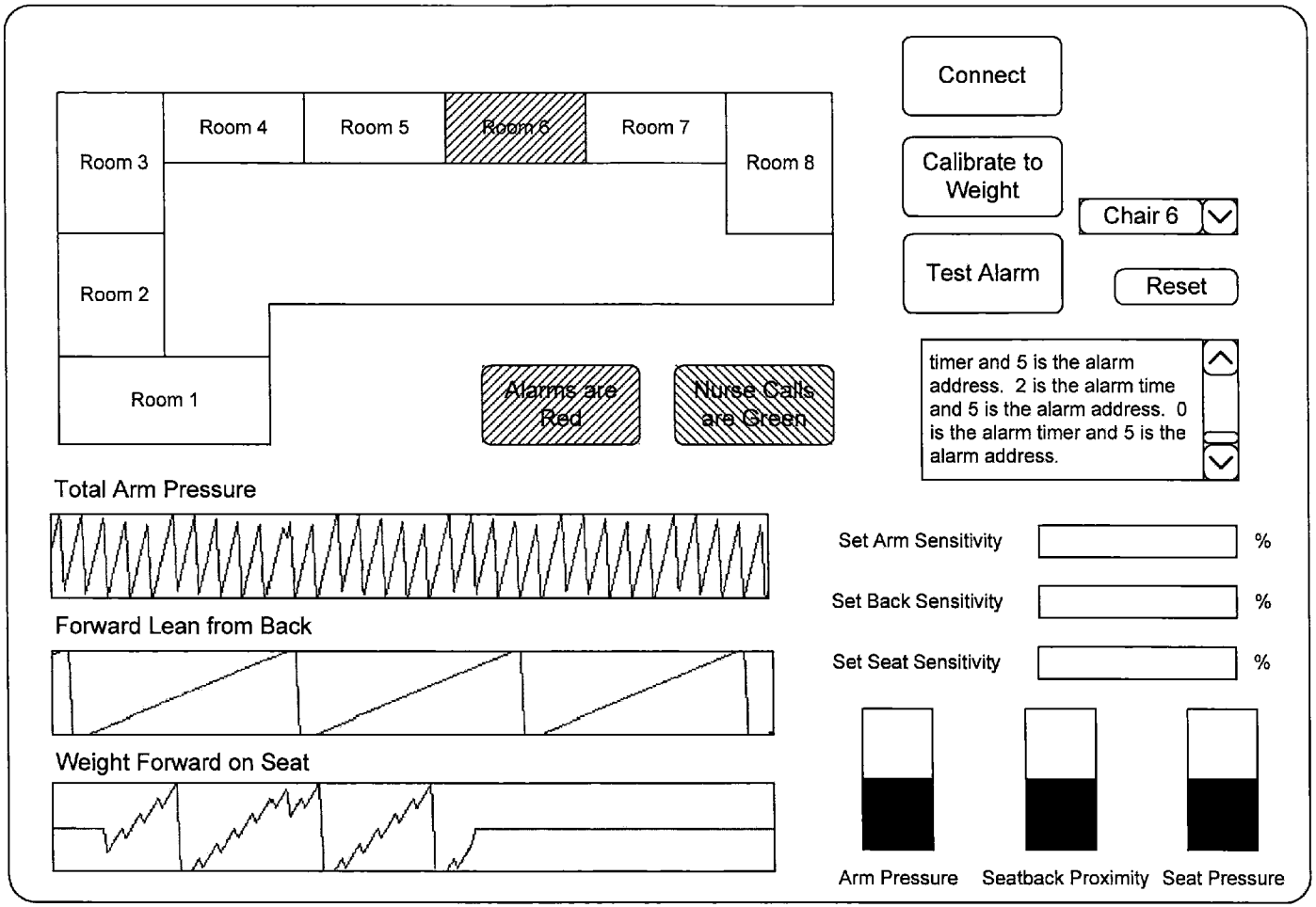
FIG. 12 is a diagram of a graphical user interface for a wheelchair alarm system.

FIG. 12 shows a data visualization system at the nurses' station the can help nurses find the at-risk patient fast. In the system shown in FIG. 12, specific chairs are assumed to always reside in specific rooms or locations. Tracking which routers pick up the chair WiFi signal, given a map of routers, could further aid in determining the location of the chair. Data visualization system includes a graphical user interface that includes the ability to view and manipulate the current status of the patient through parameter graphing, as well as remote sensitivity adjustment, testing and calibration functionality.

The data visualization system and graphical user interface (GUI) can include the following components:

- A 'Connect' button that opens a virtual serial port and begins streaming and logging the chair data.
- A 'Calibrate' button that allows the nurse to calibrate a chair remotely. Sensitivity level parameters, normally set in the calibration routine can be fine-tuned by the nurse.
- For reliable system performance, it is critical test that a system is working. To that end, the GUI includes an alarm testing routine, in which the user selects a chair. A red blinking light in the corresponding room on the localization map as well as the alarm activation on the chair will indicate proper system function. This test currently runs for 15 seconds.
- The GUI mapping can be expanded to include alerts for when the battery of the device is running low
- Real-time graphing of salient behavior levels, such as total arm pressure, forward lean from the chair-back and weight forward on seat, help the nurse understand what has led up to current patient behavior.

Figure 13:
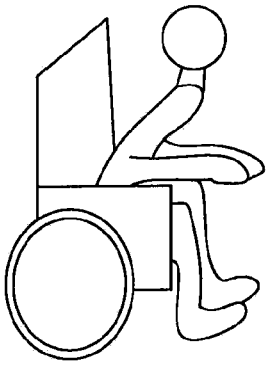
FIG. 13 is a perspective view of a patient leaning forward in wheelchair.
Figure 14:
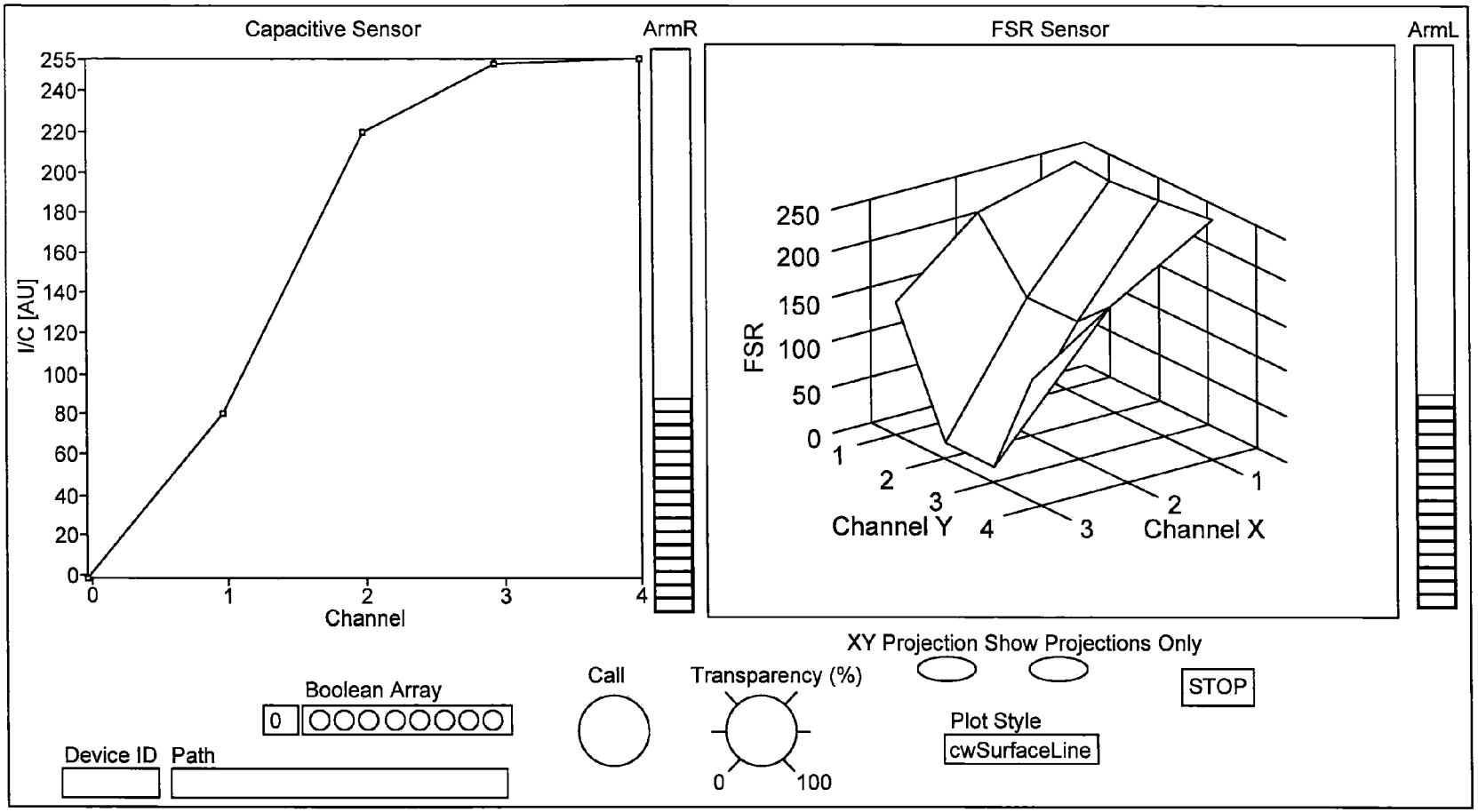
FIG. 14 is a data visualization of the leaning forward patient position of FIG. 13.

As a development tool for making measurements and optimizing the sensor system and levels, LabView was used to create a visualization of the measured outputs as seen in FIG. 14. The measured outputs seen in FIG. 14 correspond to the leaning forward patient position illustrated in FIG. 13. In the left half of the figure is the data from the capacitive sensors on the back, where the y-axis is proportional to the user's distance from the chair and the x-axis runs from the top to the bottom of the chair. Thus, the bottom left corner corresponds to the meeting of the seat with the chair back and the data represents a person leaning forward in the chair, as shown in FIG. 13.

The invention claimed is:

1. A method for preventing a person from falling from a chair, comprising the steps of:

sensing a plurality of seating position parameters with a plurality of sensors located on the chair;

determining at least one gesture state from the plurality of seating position parameters;

determining whether the at least one gesture state indicates or predicts a risk condition;

providing an alarm when the risk condition is indicated or predicted by a processor; and wherein the step of determining the at least one gesture state from the plurality of seating position parameters comprises:

deriving a plurality of derived features from the seating position parameters;

determining from at least one of the plurality of derived features a probabilistic score for the at least one gesture state; and triggering the at least one gesture state when the probabilistic score is above a threshold score.

2. The method of claim 1, wherein the probabilistic score is calculated by adding the derived features associated with the at least one gesture state.

3. The method of claim 2, wherein the step of calculating the probabilistic score comprises weighting the at least one derived feature with a patients weight.

4. The method of claim 1, wherein the plurality of seating position parameters comprise a plurality of distances between a chair back and a patient, a plurality of pressures on a chair seat, and a plurality of pressures on a set of chair arm rests.

5. The method of claim 4, wherein the plurality of derived features comprises at least one static derived feature, at least one velocity derived feature, at least one time derivative derived feature, and at least one integrated derived feature.

6. The method of claim 4, wherein the at least one gesture state is one of a slouching gesture state, a high movement gesture state, an attempting to exit chair gesture state, a standing up gesture state, and a falling out of chair gesture state, and a out of chair gesture state.

7. The method of claim 1, wherein the alarm comprises at least one of a local voice alarm, a local visual alarm, and a remote alarm.

8. The method of claim 1, further comprising calibrating a set of sensitivity level parameters for a specific patient.

9. The method of claim 8, wherein the set of sensitivity level parameters are used to scale the plurality of seating position parameters.

10. The method of claim 1, further comprising the step of initiating an electronic voice communication channel.

11. The method of claim 1, further comprising the step of initiating a nurse call.

12. The method of claim 1, further comprising the step of retrofitting the plurality of sensors on the wheelchair.

13. An alarm system for a chair, the alarm system comprising:

a plurality of sensors configured to generate a plurality of seating position parameters;

an alarm;

a controller configured to receive the plurality of seating position parameters, determine at least one gesture state from the plurality of seating position parameters, determine whether the at least one gesture indicates or predicts a risk condition, and activate the alarm when the risk condition is indicated or predicted; and wherein the controller is further configured to derive a plurality of derived features from the seating position parameters, determine from at least one of the plurality of derived features a probabilistic score for the at least one gesture state, and trigger the at least one gesture state when the probabilistic score is above a threshold score.

14. The alarm system of claim 13, wherein the plurality of sensors comprises a plurality of proximity sensors and a plurality of force sensors.

15. The alarm system of claim 13, wherein the plurality of sensors are fitted in a wheelchair.

16. The alarm system of claim 13, further comprising a nurse call button configured to cause the controller to transmit a nurse call.

17. The alarm system of claim 13, further comprising a wireless connection.

18. The alarm system of claim 13, wherein the alarm is at least one of a local audible alarm, a local visual alarm, and a remote alarm.

* * * * *